United States Patent [19]

Sloan

[11] 4,249,865

[45] Feb. 10, 1981

[54] CONTROL MEANS FOR PREVENTING WATER OVERFLOW INTO VACUUM TYPE PRIMING PUMP

[76] Inventor: Albert H. Sloan, 4200 Kean Rd., Fort Lauderdale, Fla. 33314

[21] Appl. No.: 51,539

[22] Filed: Jun. 25, 1979

[51] Int. Cl.[3] ..... F04D 9/00

[52] U.S. Cl. ..... 417/200

[58] Field of Search ..... 417/199 A, 200, 295, 417/297, 297.5, 298, 36, 45, 244, 253

[56] References Cited

U.S. PATENT DOCUMENTS

| | | | |
|---|---|---|---|
| 1,940,007 | 12/1933 | Moore | 417/199 A |
| 3,904,319 | 9/1975 | Paish et al. | 417/199 A |
| 4,029,438 | 6/1977 | Sloan | 417/200 |
| 4,120,611 | 10/1978 | Salve | 417/36 |

*Primary Examiner*—Carlton R. Croyle
*Assistant Examiner*—Edward Look
*Attorney, Agent, or Firm*—James E. Nilles

[57] ABSTRACT

An engine driven impeller type pump for draining water from a plurality of well points is primed by an engine driven oil filled vacuum pump which is connected to the top of a vacuum chamber mounted on the impeller pump housing. A normally open solenoid valve located between the vacuum chamber and vacuum pump is controlled by an electrical control system to prevent water overflow from the vacuum chamber into the vacuum pump. The electrical control system includes low level and high level probes which are located near the lower and upper ends, respectively, of the vacuum chamber, and which are connected in first and second oscillator circuits, respectively. The oscillator circuits are connected to a logic circuit and the latter is connected to a drive circuit which operates the solenoid valve. When the water level in the vacuum chamber rises to the high level probe, the normally open solenoid valve closes and remains closed until the water level recedes below the low level probe.

10 Claims, 11 Drawing Figures

CONTROL MEANS FOR PREVENTING WATER OVERFLOW INTO VACUUM TYPE PRIMING PUMP

BACKGROUND OF THE INVENTION

1. Field of Use

This invention relates generally to water pumping apparatus and systems which employ vacuum type priming pumps. In particular, it relates to electrical control systems for preventing water from overflowing from a vacuum chamber into the vacuum type priming pump.

2. Description of the Prior Art

Prior art water pumping apparatus and systems of the type to which the present invention is applicable are shown in my U.S. Pat. No. 4,029,438 entitled "Well Point Pumping System And Pump Assembly Therefor" which issued June 14, 1977. That patent discloses a well point pumping system which includes a series of well points installed in an area of the ground which is to be dewatered or dried out prior to excavation. An engine driven impeller type pump is connected for drawing water from the well points and for then discharging it elsewhere. Since the impeller type pump is usually located above the water line and since the well points pick up air as well as water, it is desirable to provide an engine operated oil-filled vacuum pump to maintain the impeller pump primed. In the prior art system, the vacuum pump is connected to a float housing which is mounted on and receives water from the housing of the impeller pump. Since entry of water from the float housing into the vacuum pump would cause loss of vacuum and possible damage to the oil-filled vacuum pump, the float housing is divided into two compartments, one of which contains a float valve which is responsive to the water level in the float chamber and operates (raises) to block the possible overflow of water from the float housing into the oil-filled vacuum pump when the water level rises to a relatively high level. The float housing also contains a normally open electric float switch to shut down the engine and stop the vacuum pump in the event the float valve fails to operate correctly. The aforedescribed float valve and the mechanical linkage associated therewith is relatively complex and costly to fabricate and install and occasionally fails to operate correctly. More specifically, in the prior art well point system using a mechanical valve, the mechanical valve creates several problems. Not only is it expense to build, but due to its weight, it is slow-acting, i.e., the water would sometimes travel faster than the valve could respond, thus allowing some water from the well point to enter into the vacuum pump system. Also due to the high cycle rate of the system, the valve and linkage tends to wear out quickly. Also, it is necessary to have float integrity, and any crack or small hole in the float would cause it to sink and become defective.

SUMMARY OF THE INVENTION

In accordance with the present invention there is provided improved means for preventing water from overflowing from a vacuum chamber into a vacuum type priming pump for an impeller type pump used in a well point pumping system.

A well point pumping system includes a series of well points installed in an area of ground which is to be dewatered, an engine driven impeller type pump connected for drawing water from the well points, an engine driven vacuum pump connected to a vacuum chamber on the housing of the impeller type pump for maintaining the impeller type pump primed, a normally open solenoid valve between the vacuum pump and the vacuum which is closeable to prevent overflow of water from the vacuum chamber into the vacuum pump, and an electrical control system responsive to the water level in the vacuum chamber to operate the solenoid valve. The electrical control system includes a low water level probe near the bottom of the vacuum chamber, a high water level probe near the top of the vacuum chamber, first and second oscillator type detector circuits connected to the low and high water level probes, respectively, a logic circuit for receiving signals from the detector circuits, and a driver circuit responsive to the output signals from the logic circuit for operating the solenoid valve and an indicator device indicative of solenoid valve condition (i.e. open or closed). In operation, the normally open solenoid valve remains open after the rising water level passes the low water level probe until the water level reaches the high water level probe, whereupon the solenoid valve closes to prevent overflow from the vacuum chamber into the vacuum pump. As the water level descends below the high water level probe, the solenoid valve remains closed until the water level descends below the low water level probe, whereupon the solenoid valve opens. A float type check valve between the solenoid valve and the vacuum chamber prevents overflow in the event the electrical control system fails to operate.

The apparatus and electrical control system in accordance with the present invention offer several advantages over the prior art. For example, complex, costly and mechanically unreliable float mechanisms formerly required to prevent water overflow into the vacuum pump are eliminated and replaced by a low cost, relatively simple and reliable electrical control system having only one movable component; namely, a solenoid valve. Furthermore, the new arrangement eliminates the need for a two-compartment float housing, since only one vacuum chamber is now required. The electrical control system employs a pair of simple trouble-free probes, each of which takes the form of a metal rod extending into the vacuum chamber. Each probe is connected in a square wave oscillator circuit and is subjected, except when submerged, to polarity reversals on the order of 4,000 to 5,000 Hz, thereby preventing damaging build-up thereon of mineral deposits from the water in the vacuum chamber. Furthermore, each probe is mounted at a downward slant to facilitate water run-off therefrom as the water level recedes. The electronic components and circuit occupy very little space and are conveniently mounted in an easily accessible enclosed control box or panel mounted on the exterior of the vacuum chamber. The electrical control system includes protective circuits for the power supply and for the oscillator type detector circuits, as well as a fuse circuit for the driver circuit which operates the solenoid valve. The driver circuit also operates an audio/visual indicator device to provide the pump operator with a positive indication of the condition of the solenoid valve (i.e., open or closed). The high level probe is connected to the logic circuit in an asynchronous manner so that if the low level probe or its associated circuitry should fail, the high level probe would still effect closure of the solenoid valve to prevent overflow into the vacuum pump. As a further safety measure, a float type check valve is connected between the solenoid valve and the vacuum chamber to prevent overflow in the event that the water level rises above the high level probe and the solenoid valve fails to close. Instead of a simple open/close solenoid valve which operates to shut off communication between the vacuum chamber and vacuum pump, the system may employ a two-way solenoid valve which not only shuts off communication as aforesaid, but vents the vacuum pump to atmosphere so as to reduce horsepower requirements.

In addition, an electronic control requiring no moving parts inside the well point system vacuum chamber and only a solenoid valve operable for millions of cycles isolated outside the vacuum chamber is thus easy to repair.

Another advantage of the electronic control system is that hysterisis can be incorporated in the control system thus eliminating the number of cycles that the solenoid valve has to function, thus increasing the life of the valve itself just due to the fewer times it turns on and off. In the prior art mechanical system, it is necessary to have a special float chamber in which baffle means are provided to suppress the violent action of the water to increase the float life. This is expensive due to the fact that this type of construction is quite involved over a plain and simple single tank. The use of probes enables building a chamber of any configuration that is suitable for the mounting of the pump. The vacuum chamber can also be remote from the impeller housing, if necessary.

Other objects and advantages of the invention will hereinafter appear.

DESCRIPTION OF A PREFERRED EMBODIMENT

Figures 1, 2:
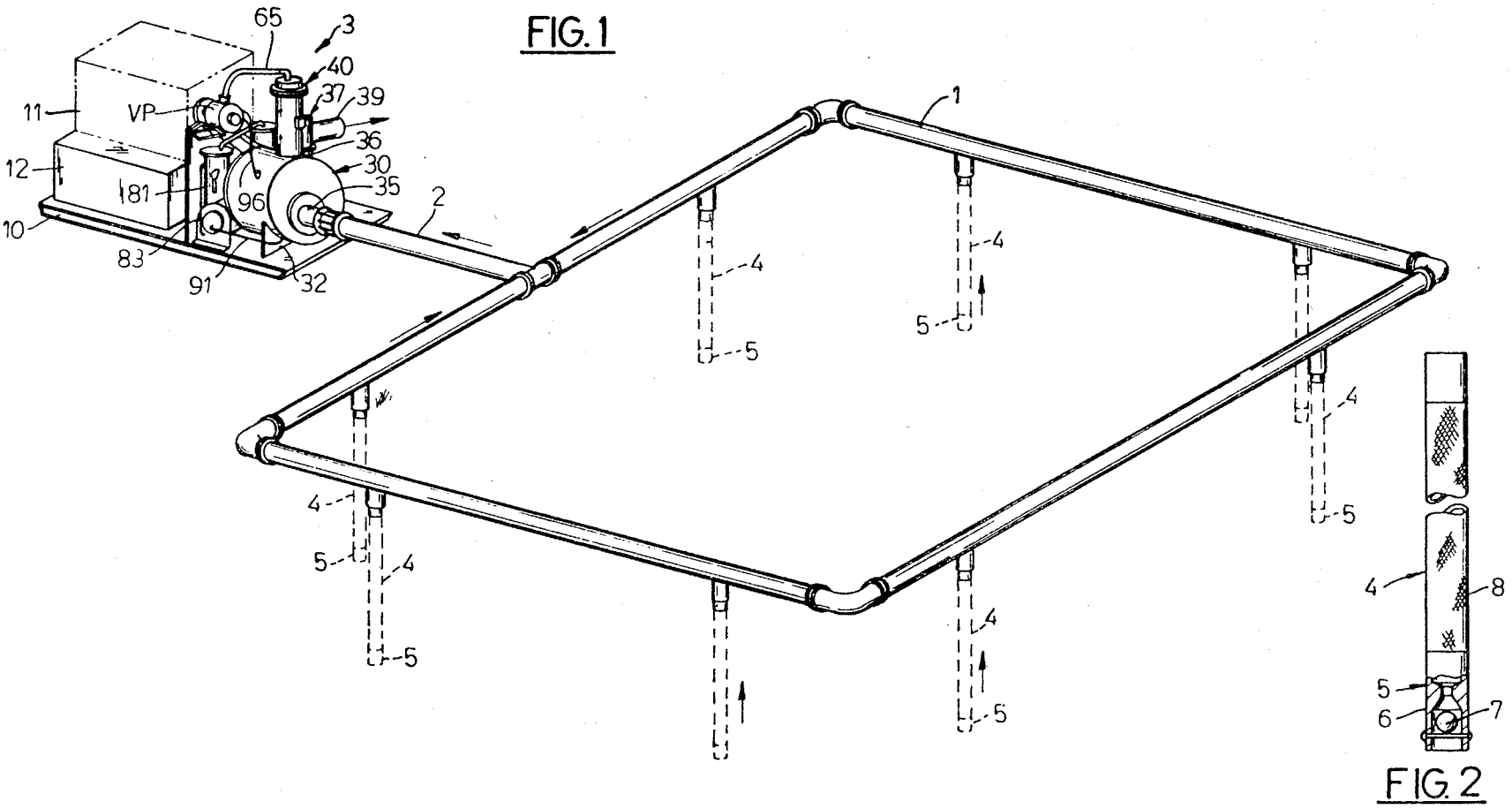
FIG. 1 is a perspective and schematic view of the pumping system made in accordance with the present invention.
FIG. 2 is an enlarged, fragmentary view partially in section of one of the well points shown in FIG. 1.

The general organization of the system is shown in FIG. 1 and includes a network of conduits 1 which are all connected together in any one of a number of patterns and lead, via conduit member 2, to the pump assembly 3. The conduit network has a series of downwardly extending conduit members 4 at the lower end of which are the well points 5 (FIG. 2). The well points are conventional in nature and include a lower end 6 having a one-way check ball valve 7 to thereby permit the well point to be forced into the ground by water that is forced under pressure through the check valve 7. Water is prevented from being drawn up from the soil by the ball valve 7. A stainless steel screen 8 permits water to enter the well point from the soil in the conventional manner.

The purpose of this general operation is to draw the water from the ground which is to be excavated to be able to more precisely form the excavated area and minimize cave-in of the ground. In other words, rather than dig an excavation for a building, for example, and then dewater the excavation so formed, the present invention contemplates drying out an area of ground prior to the excavating operation.

In an environment of the above type, the conduit arrangement is usually quite extensive and a high vacuum is required to draw the air out of the system, out of the well point assembles, and also to accommodate general air leakage in the system.

The pump assembly 3 has been shown (FIG. 3) as mounted on a skid 10 which can be moved from one location to another. A power source such as an internal combustion engine 11 is mounted on the skid, more particularly, on the engine fuel tank 12. The drive shaft 13 of the engine is connected by timing pulleys 14, 15, and timing belt 16 to a power shaft 18 which is mounted in a bearing housing 19. Thus a speed reduction ratio, of about 1 to 1.57 is provided between the engine and the shaft 18 which drives a pump IP, to be described, at a relatively low, specific speed Ns of about 1,000.

Also secured to the main frame or skid 10 is a mounting plate 20 and which serves to support the bearing housing 19 and also serves to support a vacuum pump VP to be later referred to. Power is furnished to the vacuum pump via the pulley and sheave drive 22, the lower sheaves **22*a* of which are driven by the shaft 18** at a speed reduction.

Figure 8:
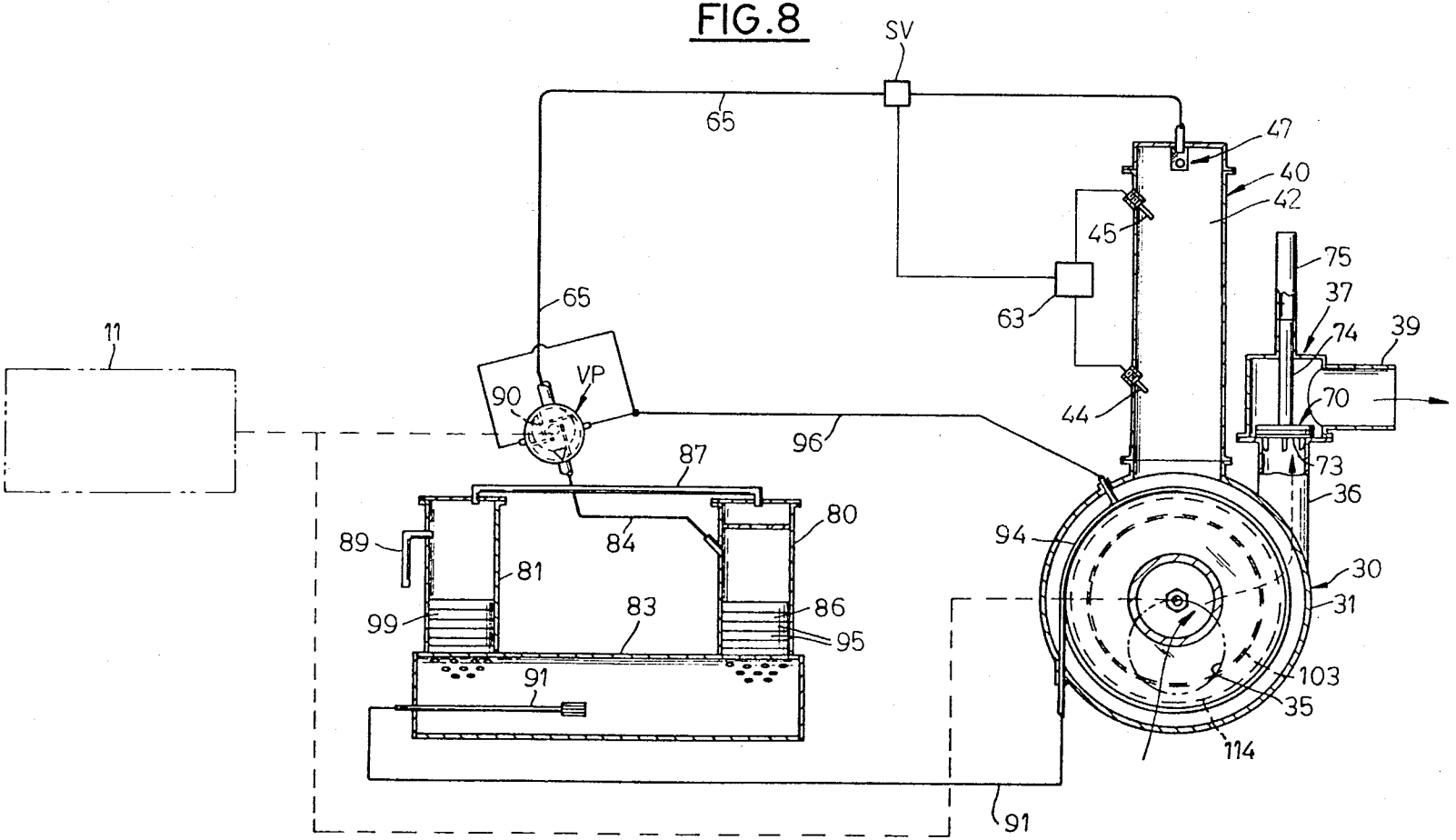
FIG. 8 is a transverse, vertical view generally schematic in nature and showing how the various parts of the FIG. 3 device are connected together, certain parts being shown as broken away or removed for the sake of clarity.

An impeller pump housing 30 is mounted at the end of the skids remote from the engine and includes a generally cylindrical side wall 31, a generally vertical back wall 34, and a front wall **31*a*. The housing 30 is supported by brackets 32 on the skid frame 10 The housing 31 supports an impeller pump IP within it, more particularly, the bearing housing 19 is supported by a flange 33 to the back wall 34 of the pump housing. A water inlet connection 35 extends from the front wall 31*a* of the housing 30 and is connected to the conduit network 1. The water drawn in by the impeller pump IP through the inlet 35 is discharged out of the tangentially extending discharge conduit 36 (FIG. 8) through the discharge valve assembly 37 and out the discharge conduit 39**.

Also extending upwardly from the top of the pump housing 30 is a housing 40. A vacuum chamber 42 is located in the housing 40.

The action of the impeller pump generally speaking is to draw the water in from the conduit network and discharge it out of the outlet conduit 39. The interior of the housing 40 is in fluid communication with the interior of the pump housing 30, as clearly shown in FIG. 6.

Figure 3:
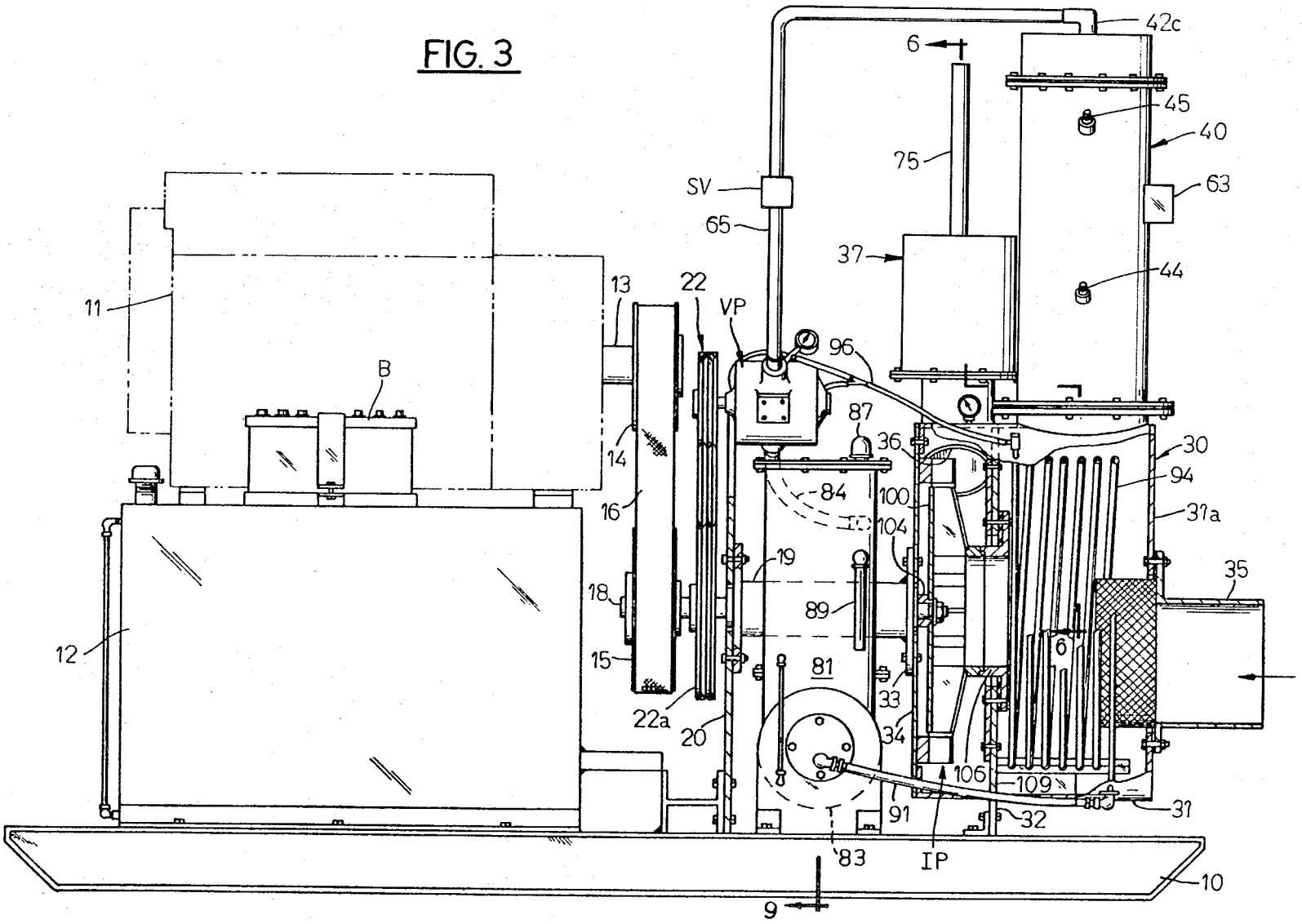
FIG. 3 is a side elevational view of the pumping apparatus shown in FIG. 1, but on an enlarged scale, certain parts being shown in section or broken away for the sake of clarity in the drawings
Figures 6, 6A:
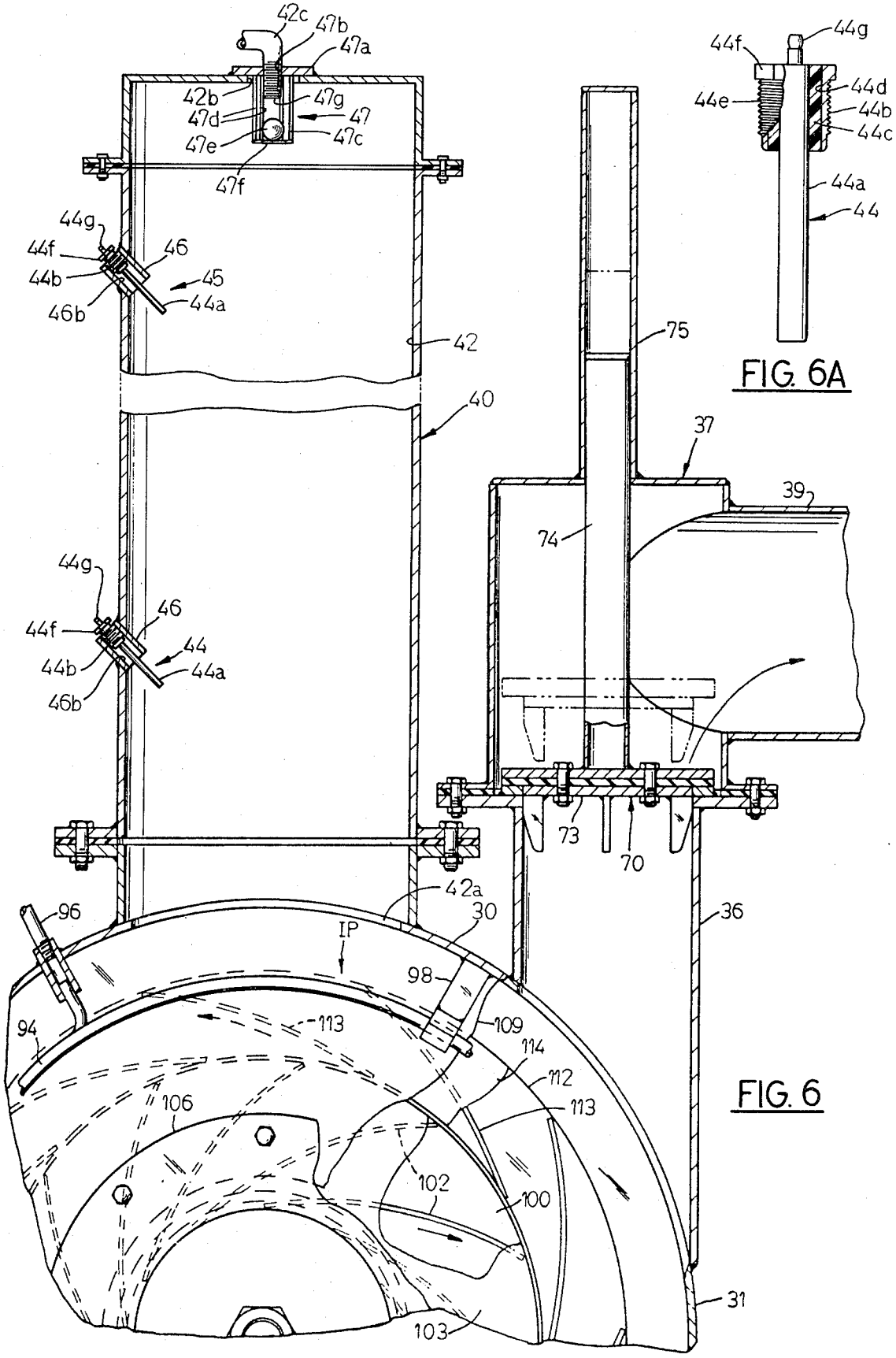
FIG. 6 is a sectional view taken generally along the line 6—6 in FIG. 3, the upper portion of the view, however, being rotated 90° from the rest of the view for clarity in showing the peller valve; the figure is also on an enlarged scale and with certain parts shown as being broken away or removed for the sake of clarity in the drawings
FIG. 6A is an enlarged cross sectional view of one of the probes as shown in FIG. 6.

As FIGS. 3, 6 and 6A show, housing 40 supports a low water level sensing probe 44 and a high water level sensing probe 45 which extend into vacuum chamber 42 near the lower and upper ends thereof, respectively. Since probes 44 and 45 are identical in construction, only probe 44 is hereinafter described in detail. Probe 44 comprises an electrically conductive rod 44*a*, preferably fabricated of alumium, which extends through and is rigidly embedded in sealed relationship in an electrically insulating mounting member 44*b* as by means of an elastically insulating potting compound 44*c*. Mounting member 44*b* comprises a hole 44*d* for accommodating rod 44*a* and the potting compound 44*c* and is provided with external screw threads 44*e* and a flat-sided hex head wrench-receiving portion 44*f*. The outer end of rod 44*a* is provided with wire connection means 44*g* which preferably take the form of a conventional spark plug terminal to insure a positive and vibration-proof electrical connection. The probes 44 and 45 are mounted through the side wall of housing 40 in such a manner that they slope downwardly to facilitate water run-off therefrom. Thus housing 40 is provided with internally threaded couplings 46 which are welded into housing 40 at an angle. The couplings have threaded openings 46*b* therethrough for receiving the screw threads 44*e* of the associated probe 44 or 45.

FIGS. 3 and 6 also show that housing 40 is provided with a lower opening 42*a* which communicates with the interior of the impeller pump housing 30 and with an upper opening 42*b* which communicates with the vacuum pump VP. More specifically, the upper end of the air conduit or hose 65, whose lower end is connected to the vacuum pump, is connected to one side or port of a solenoid valve SV, hereinafter described, and the other side of the solenoid valve is connected to an elbow 42*c* which, in turn, is threaded into a float valve assembly 47 at the upper end of housing 40. Float valve assembly 47 includes a flange 47*a* which is secured to the top of housing 40 as by welding. Flange 47*a* includes a threaded opening 47*b* for receiving elbow 42*c*. A cage 47*c* is connected to flange 47*a* and extends downwardly through upper opening 42*b* in housing 40 into vacuum chamber 42. Cage 47*c*, which is pierced with water-receiving openings 47*d*, contains a float member or ball 47*e* which, unless water is present, normally rests on the floor 47*f* of cage 47*c*. Ball 47*e* is adapted to raise up and seat in sealed relationship against a valve seat 47*g* defined by the lower end of elbow 42*c* when the water level in vacuum chamber 42 rises sufficiently for the high level probe 45. Float valve assembly 46 is a back-up system which comes into play to prevent water flow from vacuum chamber 42 into vacuum pump VP in the event that the electrical control system for solenoid valve SV, or the solenoid valve SV itself, should fail, and the water level in vacuum chamber 42 has reached dangerously high levels.

With regard to solenoid valve SV, it may either take the form of a conventional open/closed valve which is closed when the solenoid coil thereof is deenergized and which opens when the solenoid coil is energized. Such a valve, when closed, prevents water flow into vacuum pump VP. If preferred, however, the solenoid valve may take the form of a two-way valve which, when deenergized and closed, not only prevents water flow into the vacuum pump VP but also vents the latter to atmosphere, thereby reducing the load imposed on the vacuum pump VP and the internal combustion engine 11.

Figure 7:
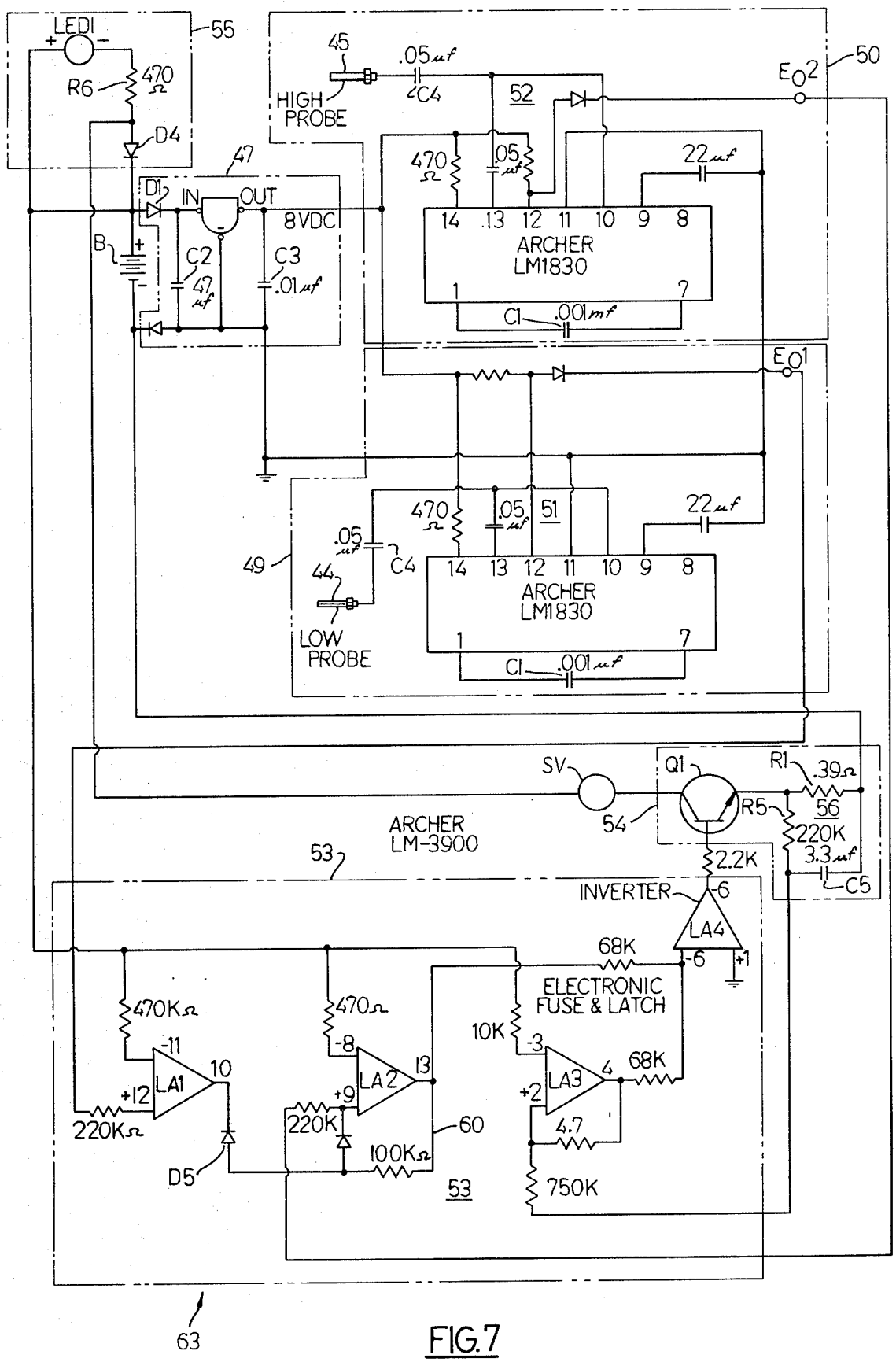
FIG. 7 is an electrical circuit diagram employed in control means in accordance with the present invention.

Referring to FIG. 7, there is shown an electric circuit diagram for the electrical control means or system in accordance with the present invention. Generally considered, the control system for operating the solenoid valve SV comprises: an electric power supply in the form of a battery B and a voltage regulator 47 and protective circuit therefor; a low water level detector circuit 49 to which low water level probe 44 is connected; a high water level detector circuit 50 to which high water level probe 45 is connected; protective circuits 51 and 52 for the detector circuits 49 and 50, respectively; a logic circuit 53 for receiving input signals from the detector circuits 49 and 50 and for providing an output signal to a driver or power output circuit 54 which operates the solenoid valve SV. The power output circuit also operates an indicator circuit 55 which indicates to the machine operator the condition (i.e. open or closed) of solenoid valve SV. A fuse circuit 56 is provided to protect the power output circuit 54.

The detector circuits 49 and 50 each take the form of oscillator circuits and each includes solid state type oscillator device in the form of an Archer Model LM1830 integrated circuit. The oscillator circuits 49 and 50 each oscillate at a frequency of about 4,000 to 5,000 Hz and are connected so that a square wave signal of this frequency (with a peak-to-peak voltage of one volt) normally appears at each probe, which signal varies between plus (+) and minus (−) polarity. When the water level rises and touches a probe 49 or 50, the probe goes to zero voltage and the associated oscillator circuit senses or detects the ground and the output voltage at the appropriate oscillator output terminal $E_o1$ or $E_o2$ increases from a low (or zero) value to a high value and thereby turns on its associated logic amplifier.

The logic circuit 53 includes a solid state type logic device in the form of an Archer Model LM-3900 Quad logic amplifier. Each detector circuit 49, 50 comprises an oscillator, a detector, and an output transister, all embodied in one solid state device LM 1830. In operation, the oscillator impresses a voltage on the associated probes 44, 45 of about one volt positive and negative or roughly one volt peak-to-peak. The frequency in oscillation is determined by an external capacitor C1, and a 4,000 to 5,000 Hz oscillation frequency, although chosen is not critical and could be double that or half that, for example. In detector circuit 49 or 50, if the associated probe 44, 45 is grounded, the voltage drop is great enough for the detector circuit to recognize the ground. Now the detector circuit 49, 50 can also be customized—the sensor circuit can be changed to pick up any resistance in the probe 44, 45 that is necessary. In other words, the impedance of the probe that can be sensed by the detector circuit could be customized. As the probe 44, 45 is grounded the voltage on the probe goes to zero, the detector notices this, and turns on the output transistor (not shown) in device LM 1830 which causes the voltage to drop and thus this voltage is sent to the logic circuit 53.

The power supply for the system is a 12 volt battery B which is mounted on the machine. The voltage of battery B is not very stable due to the alternator (not shown) and also to the engine starter (not shown). Therefore, an 8 volt voltage regulator 47 is used to reduce the 12 to 14 volt battery input to 8 volts. An input capacitor C2 is used to stabilize the surges that would show up in the voltage regulator and the regulator circuit is bypassed for high frequency with a 0.01 ceramic capacitor C3 to ground on the output. The input is also conducted through a one amp diode D1 which prevents the reverse voltage from blowing up or damaging the voltage regulator which would also in turn blow out the chips in the rest of the circuit.

The probes 44, 45 are each protected with a ceramic capacitor C4 of 0.05 or 0.1 microfarads, 50 volts or greater, placed in series with the probe. This prevents any dc voltage from being impressed on the detector circuits 49, 50. If this is done without the protective capacitors C4, the reaction is so violent that it blows holes in the chips LM 1830, so through the protector capacitors C4, chip damage is prevented from occurring due to incorrectly applied voltage. Both probes 44, 45 are protected in this manner.

The output load, since a grounded emitter system is used to drive a solenoid circuit, is protected by a free-wheeling diode D4 that suppresses the break-down voltage from the solenoid coil SV from creating a voltage high enough to break down the emitter-collector junction of the transistor Q1.

A fuse circuit 56 is constructed by providing a 2 watt 0.039 ohm resistor R1. This resistor value can be changed, however, if it still will be of low value. The voltage drop across resistor R1 is proportional to the current, so at about 1 volt, there is a little more than a 2 amp current in the drive circuit. The power required by the solenoid valve SV is only 8/10 of an amp continuous, or a little higher for in-rush current, so the circuit is protected against the output voltage of the transistor Q1 which is capable of four amps.

The voltage drop across resistor R1, is high enough to enable a voltage to be impressed upon amplifier LA3, one of the four in the logic circuit 53, which also serves as an electronic fuse. This voltage is greater than the hold-off voltage, so the amplifier LA3 turns on. Amplifier LA3 is also a latching amplifier due to positive feedback and this in turn energizes the inverter circuit LA4, thus effectively turning off the transistor drive circuit 54 and latches it off. The electronic fuse (or circuit breaker) function is reinstated, by simply cutting off all power to the system momentarily and turning it back on. If any short has been corrected, the system runs normally.

An important feature to be noted is that transient loads across the transistor Q1 are picked up by the amplifier LA3 and must be suppressed to prevent an incoherent "on" signal. This is done by a capacitor C5 and resistor R5 in the circuit 54 which acts as a time delay means so an actual over-current condition must exist for about a second before the circuit 54 shuts down.

The indicator system operates as follows. The output from transistor Q1 is fed through a 470 ohm resistor R6 and LED 1 is mounted remotely on the circuit board.

One side of the solenoid valve SV is connected to the positive terminal of the battery B. The other side of valve SV is connected to the output transistor Q1. When the output transistor Q1 turns on, the emitter now conducts the current to ground, thus closing the energizing circuit for the solenoid. The read-out circuit which includes LED1 is located after the solenoid SV. When the transistor Q1 is not energized (not on), the voltage on the circuit is positive. The other end of LED 1 is also connected to the positive side of battery B. When the transistor Q1 turns on, there is a voltage drop across the solenoid SV, what was positive becomes negative, and current flows from the positive terminal of battery B and adds to the current of the solenoid valve SV so that the transistor Q1 is actively conducting both currents of the LED 1 and the solenoid valve SV. When the water leaves the high probe 45, the output of transistor Q1 remains in the "off" state and solenoid valve SV remains closed, due to the latched condition of amplifier LA3 in the logic circuit 53. As the water leaves the low probe 44, the latching current is removed, the logic circuit 53 output now becomes high, turning on or opening the solenoid valve SV. The cycle repeats itself over and over in accordance with water levels in vacuum chamber 42. The reason for the two probes 44 and 45 is to provide a hysterisis that prevents the valve SV from fluttering off and on. In other words, the water is allowed to rise and fall a couple of feet prior to turn on and turn off, thus effectively reducing the cycle time of the valve SV and extending the valve life considerably.

Upon the low probe 44 becoming wet, the output of the detector circuit 49 becomes high, this in turn turns on the low probe logic amplifier LA1. The output of the low probe logic amplifier LA1 is blocked by a diode D5 and none of the output current is able to get into the rest of the circuit. Upon the high probe 45 becoming wet, the detector circuit 50 becomes high and energizes the high probe logic amplifier LA2 which in turn latches in the "on" position due to positive feedback circuit 60 back into the positive terminal +9 of amplifier LA2. The output of amplifier LA2 is then directed to the inverter amplifier L4 which inverts the logic of the system. In other words, when the signal out of the high probe logic circuit LA2 is high, the output to the drive transistor Q1 is low because inverter LA4 performs an inverting function. As the water goes down and leaves the high probe 45 dry, the detector circuit 50 becomes low. However, due to the latched state of the high probe logic amplifier LA2, it remains on. As the water continues to fall and then covers the low probe 44, its detector circuit 49 now goes low. The logic amplifier LA1 now is turned off and its output is reduced to approximately 0.1 volt. The diode D5 that was blocking the output of LA1 now allows the latching current of the high logic amplifier LA2 to be directed through it to ground, thus unlatching the high probe logic amplifier LA2 and turning the whole system off. Since the voltage out of the high probe logic amplifier LA2 is low, the inverter LA4 inverts this function and turns the output of the drive circuit 54 to high. The cycle is now complete.

The logic circuit 53 is unique in that instead of using digital integrated circuits, current comparators are used that can be latched on or off and provide feed back which can be used to latch or unlatch at will. If the inverted input of LA4 is held higher than the non-inverted input, the amplifier is held low. If the opposite occurs, the amplifier is turned on or goes high. Due to feedback, it is possible to latch and unlatch any of the amplifiers at will, so that in the initial condition, with no voltage on the probes, the high probe logic amplifier LA2 and the low probe logic amplifier LA1 are both in a low state. It is noteworthy that the high probe amplifier LA2 can become asynchronously shut-off. In other words, if the low probe system would fail, the high probe system would turn the system off and on with very little hysterisis but would still operate and function. If all power fails, this system is set up in a normally off position so that the valve SV remains closed, thus protecting the vacuum pump VP from flooding and eventual failure caused thereby. The high logic probe 45 is initially held off, and as the input becomes high, it is turned on. As it is turned on, the output is now fed into the circuit that initially turned it on, thus causing a latched state. To unlatch, the system simply drains the latching current by means of the low probe amplifier LA1 which drains the latching current away from the high probe logic circuit LA2 and this effectively will turn it off.

Referring again to the discharge housing 37, a vertically shiftable valve 70 is shown in full lines in FIG. 6 whereby no air can enter the impeller pump housing. The broken line position of the valve assembly shows the valve when raised to a water discharging position. The valve assembly 70 includes a plate valve element 73 and has a plunger rod 74 extending forwardly therefrom. The plunger rod is guided in an upwardly extending cylindrical tube 75. Thus, the valve assembly 70 functions to prevent air from being sucked into the system when the impeller pump is not actually pumping water out of the discharge conduit 39.

The system also includes the vacuum pump VP which as indicated sucks air out of the system via the housing 40 and vacuum chamber 42. This air is then discharged into an exhaust system which comprises two vertically arranged tanks 80, 81 (FIG. 8) which are in communication with a horizontally disposed tank 83. The air is conducted first to tank 80 and then through a pipe 87 and to the other tank 81 where it can be discharged to atmosphere via the outlet pipe 89. The present invention also contemplates that the vacuum pump VP is flooded with oil to promote sealing of its sliding vanes 90 and also to cool the pump. The vacuum pump of the present invention can pump a very large quantity of air with approximately two gallons of oil. This oil is taken from the reservoir 83 via line 91 and then to a heat exchanger 94 in the form of a coil tube which may be as much as 50 feet in length and formed of $2\frac{5}{8}$ inch copper tubing. The heat exchanger 94 is held in place by brackets 98 (FIG. 6). After the oil is cooled by the incoming water, it then enters the vacuum pump via line 96. After being mixed with air in the pump VP, the mixture of air and oil is discharged via line 84 from the pump and into the vertical tank 80 as previously mentioned. The oil may be passed through a series of filters 86, such as six to eight inch latex covered fiber discs 95, and is collected in the horizontal tank 83. When the air is transferred to tank 81 via line 87, any oil remaining in it is then passed through the filters 99 and into the collecting tank 83. Within the collecting tank 83 is an outlet pipe 91 which as mentioned leads to the heat exchanger.

The lubricating of the vacuum pump is of a flooding nature rather than simply that of dripping oil on the vanes as in prior art devices, and permits the vacuum pump to run at much higher vacuums.

Figure 4:
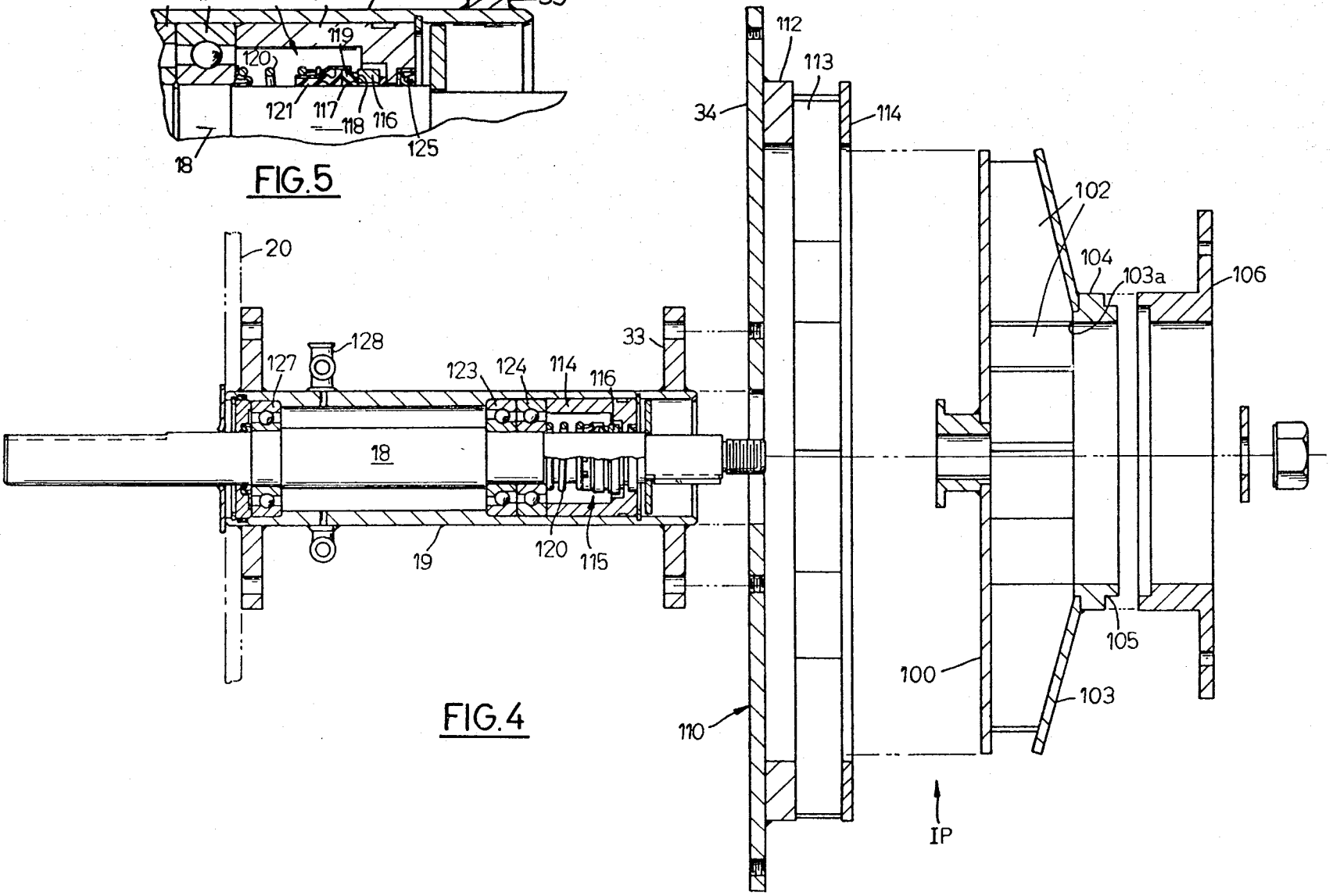
FIG. 4 is an exploded section view of the assembly of the pump drive shaft, and the impeller, diffuser, and wear ring shown in FIG. 3.

Referring now in detail to the impeller type pump, and particularly to FIGS. 3, 4 and 6, the impeller of the pump comprises a flat, rear vertical circular plate 100, the front plate 103 of generally dish-shape, and having a central opening **103*a* which generally forms the "eye" of the pump. The two plates are rigidly secured together and spaced apart by the series of curved vanes 102 which curve in a direction shown in FIG. 6. Thus, a series of circular or spirally shaped channels are formed in the impeller and through which the water passes as the impeller rotates; that is, the water enters the eye of the impeller and then passes radially outwardly and its speed is increased by the rotating impeller. A front mounting hub 104 is secured to the impeller plate 103 and has an annular groove 105 which forms a seat for rotatably supporting the front end of the impeller in a wear plate 106. The wear plate is adjustably secured to the center wall 109** of the pump housing.

The pump also includes a diffuser member 110 comprised of rear mounting plate 34 and a ring 112 welded thereto. A series of curved vanes 113 are secured to the ring 112 and also secured to a front ring 114. The curvature of the vanes 113 is in the direction opposite to the curvature of the vanes of the impeller. Thus, the impeller discharges water radially to the vanes 113 of the stationary diffuser member and the water is then exited radially from the diffuser member. The above impeller/diffuser type pump is of low specific speed, approximately 1,000 rpm, but operates at high velocity and good efficiency. The pump acts to convert the velocity of incoming water to static head. There is little horsepower lost because entrapment of air for cavitation between the blades is prevented, primarily due to the slow specific speed and the relatively large diameter size of the pump. The pump is driven at a speed considerably less than that of the source of power and excessive chopping or churning action of the water is prevented and consequently, cavitation is held to a minimum. The water entering the eye of the pump is at a rather slow speed but increases as it moves radially along the pump vanes converting the velocity head to static head with good efficiency and no cavitation.

Figure 5:
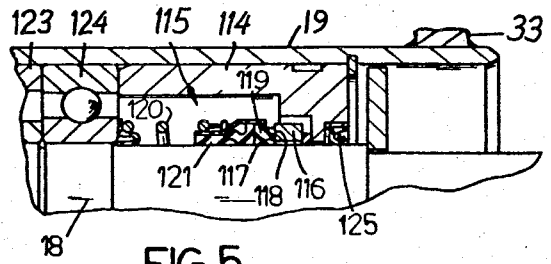
FIG. 5 is an enlarged fragmentary view of a portion of FIG. 4.

An integral unit is formed by the pump housing and the drive shaft assembly. The drive shaft assembly for the impeller of the pump is so constructed so that a minimum number of bearings is necessary and there is no overhang of the shaft which would otherwise contribute to wear of the bearings and other parts and generally short life of the assembly. As shown in FIGS. 4 and 5, a rotary seal 115 is used between the pump housing wall 34 and the bearing shaft 18 and it keeps water out of the shaft bearing housing 19. This mechanical, rotary sliding seal 115 is mounted in a tubular seal holder 114 and includes a ring 116 having a ground flat radial surface 117 against which a ground flat surface 118 of a ring 119 is spring loaded by spring 120. Ring 119 is formed preferably of tungsten carbide and is cemented to a flexible boot 121, a pair of anti-friction ball bearing assemblies 123 and 124, journal shaft 18 in the housing 19, a flexible seal 125 is press fit in the counterbored end of the seal holder 114 and serves primarily to keep out dirt.

The bearing shaft assembly also includes another anti-friction bearing assembly 127 at the other end of shaft 18. The interior of shaft housing 19 is filled with oil via inlet 128 and is thus pressurized with oil to lubricate the various bearings and also prevent water from entering the impeller end of the bearing shaft assembly. Furthermore, with the above-described bearing arrangement, the bending movement on the drive shaft is minimized and provides good support for the impeller located on the end of the drive shaft. A short drive shaft is thus made possible, the number of bearings is held to a minimum, and efficient sealing between the incoming water of the pump and the bearing assembly is provided.

OPERATION

The generally organization of the system is as follows. To commence a pumping operation, the engine is turned on and the vacuum pump commences sucking the air out of the conduit network including the well points themselves. As the vacuum pump is draining the system of the air, the water from the ground enters the impeller pump. The water continues to be sucked by the vacuum pump into the vacuum chamber, causing the water level to rise to a certain height or level which fluctuates during operation.

The vacuum pump functions to take care of the air leaking into the various conduits, and elsewhere in the system and accommodates a steady volume of air which passes through the system and functions to keep the impeller pump primed at all times. Thus, the vacuum chamber is filled and can then act to prime the system.

The primed impeller pump then picks up the load and pumps the water from the conduit network and well points thereby commencing to drain the ground being dewatered. At the same time, the vacuum pump continues working to suck the air out of the system and it also aids in pulling the water into the impeller pump which itself also acts to create a vacuum to draw in the water. The pump is of the impeller/diffuser type, as opposed for example to a volute type, and this pump has a ring of generally curved and radial passages stationarily mounted around its impeller. The water enters the impeller rather slowly from the pump inlet but is then pushed rapidly by the impeller and through the diffuser, thereby the velocity of the water is converted to static head.

While the vacuum pump is running, oil is used to lubricate it and a steady flow of oil acts to maintain the vacuum pump vanes sealed and thereby provide better suction. The vacuum pump of the present invention is actually flooded with oil as opposed to prior art devices which simply cause oil to be dripped rather slowly into the pump. The oil from this flooded vacuum pump system is passed through an oil and air separator and then is cooled by a heat exchanger located in the flow path of the incoming water.

Figure 10:
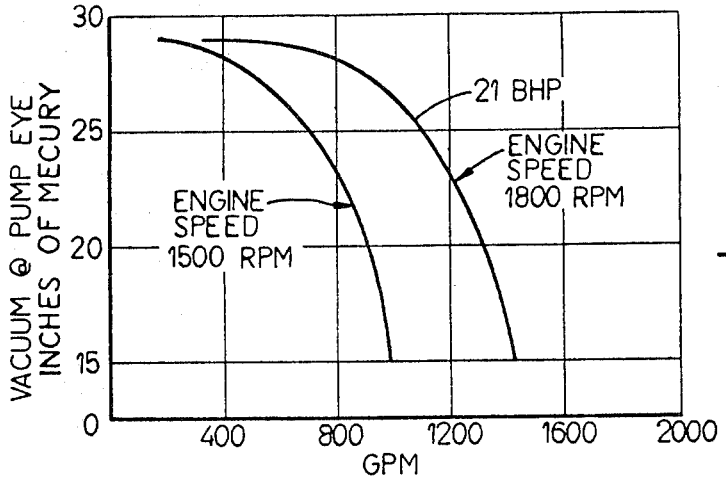
FIG. 10 is a graph of the operating characteristics of a system made in accordance with the present invention and is a plot of inches of mercury of vacuum plotted against gallons per minute discharge of the pump and at two different engine speed.
Figure 9:
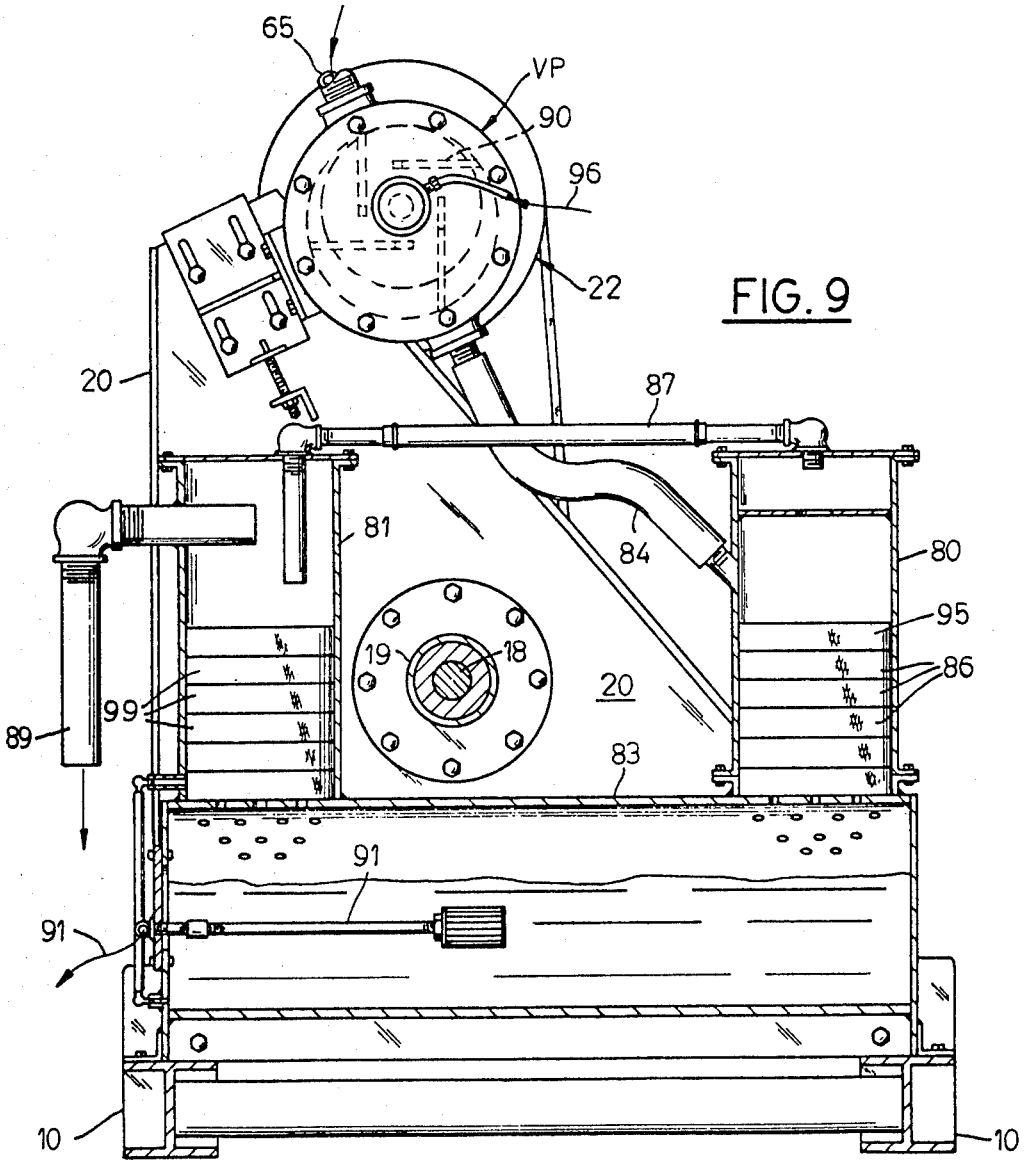
FIG. 9 is a transverse, vertical view taken generally along the line 9—9 in FIG. 3.

The characteristics of the well point pump of the type involved in the present invention are best illustrated by measuring the discharge of the pump in comparison to the inches of vacuum of the pump, for example, as measured at the eye of the pump. The graph of FIG. 10 illustrates the characteristics of the present invention and shows how the well point pump of the present invention is very efficient in inducing water into the pump at various inches of vacuum of mercury as measured at the eye of the pump. In other words, this ability of the pump is commonly referred to as its ability of "suck" water into the pump which is actually measured as net water pressure or how much the pump will induce water into itself. The graph shows such volume of water plotted against the inches of vacuum as measured at the eye of the pump and for two different engine speeds.

In general in regard to the system, the present pump assembly has high lift and high vacuum capabilities, and provides large air handling capacity with low maintenance and at high efficiency.

The control system for preventing overflow from vacuum chamber 42 into vacuum pump VP operates as follows. It is to be understood that during typical pumping operating the impeller pump IP draws a mixture of water and air into impeller pump housing 30 and as a result the water level within vacuum chamber 42 constantly fluctuates, rising when little air is present and filling when much air is present.

When the water level in vacuum chamber 42 is below the low probe 44 and starting to rise, then both probes 44 and 45 are out of contact with water and their respective detector circuits 49 and 50 are grounded, the output terminals $E_o1$ and $E_o2$ for each detector circuit is zero, and the emitter-collector circuit of transistor Q1 is closed thereby establishing an energizing circuit for solenoid valve SV across battery B which maintains the solenoid valve SV open. When the water level reaches low probe 44, the voltage on the latter goes to zero and the detector circuit 49, sensing the grounded condition goes high and provides an output voltage at its terminal $E_o1$ thereby turning on the logic amplifier LA1. However, since the high probe 45 is still off, the transistor Q1 remains closed and solenoid valve SV remains open. When the water level reaches high probe 45, the voltage on the latter also goes to zero and its detector circuit 50, sensing the grounded conditions goes high and provides an output voltage at its terminal $E_o2$ thereby turning on the logic amplifier LA2. When the latter turns on, it actuates logic amplifier LA4 (serving as an inverter circuit) and causes the transistor Q1 to open or turn off thereby de-energizing solenoid valve SV and causing the latter to close. When transistor Q1 turns off, it also causes the LED1 to light up and indicate that solenoid valve SV is closed. Turn-off of transistor Q1 also actuates the logic amplifier LA3 causing the latter (which serves as an electronic latch) to hold inverter LA4 in a condition wherein transistor Q1 remains open and the solenoid valve SV remains closed. Thus, solenoid valve SV closes and remains closed as long as the water level in vacuum chamber 42 is at or above the high probe 42.

However, when the water level recedes below high probe 45, solenoid valve SV remains closed because even though high probe 45 is no longer grounded and its detector circuit 50 allows the output voltage at terminal $E_o2$ to drop to zero, the latching amplifier LA3 prevents the transistor Q1 from turning on and energizing the solenoid valve SV to open condition. When the water level recedes further and goes below the low probe 44, the latter is no longer grounded and its detector circuit 49 allows the output voltage at terminal $E_o1$ to drop to zero. When both logic circuits LA1 and LA2 are so actuated, electronic latch LA3 releases thereby allowing inverter LA4 to turn on transistor Q1 and causing solenoid SV to open.

The foregoing cycle repeats itself as often as necessary. In the event that the solenoid valve SV fails to close when it should, due either to a failure of the valve SV or the electrical control circuit therefor, the float valve assembly 46 comes into play. As the water level in vacuum chamber 42 rises above high probe 45 and above the floor **46*f* of cage 46*c*, the ball 46*e* floats upward and seats against valve seat 46*g* thereby preventing water flow from vacuum chamber 42 into vacuum pump VP. As the water level recedes, the float valve assembly 46** reopens.

In FIG. 7, electrical connection to the solid state devices LM1830 and LM3900 are shown as being made to terminals which are numbered the same as they would be on the actual commercial embodiments of these devices. The electronic components and circuit occupy very little space and are conveniently mounted in an easily accessible enclosed control box or panel 63 mounted on the exterior of the vacuum chamber.

I claim:

1. In a well point pumping system which includes an impeller type pump, a vacuum chamber connected to receive water from said impeller type pump, and a vacuum pump connected to the upper end of said vacuum chamber for maintaining a vacuum in said vacuum chamber, in combination:

an electrically operated valve located between said vacuum pump and said vacuum chamber;

and electric control means for operating said valve, said electric control means comprising:

first means for sensing when the water in said vacuum chamber has risen to a predetermined high level and for effecting closure of said electrically operated valve;

and second means for sensing when the water in said vacuum chamber has fallen to a predetermined low level below said predetermined high level and for effecting opening of said electrically operated valve.

2. A pumping system according to claim 1 wherein said first means and said second means each include a water level sensing probe extending into said vacuum chamber.

3. A pumping system according to claim 2 wherein said first means and said second means each include a detector circuit connected to a respective probe.

4. In a well point pumping system which includes an impeller type pump, a vacuum chamber connected to receive water from said impeller type pump, and a vacuum pump connected to the upper end of said vacuum chamber for maintaining a vacuum in said vacuum chamber, in combination:

an electrically operated valve located between said vacuum pump and said vacuum chamber;

and electrical control means for operating said valve, said electric control means comprising:

a low level probe extending into said vacuum chamber and a detector circuit therefor for sensing and providing a low water level output signal when the water in said vacuum chamber has risen to a predetermined low level in said vacuum chamber;

a high level probe extending into said vacuum chamber and located above said low level probe and a detector circuit therefor for sensing and providing a high water level output signal when the water in said vacuum chamber has risen to a predetermined high level in said vacuum chamber;

and a logic circuit for receiving said low water level output signal and said high water level output signal and for effecting operation of said electrically operated valve so that when said water level reaches said low level but is below said high level said valve remains open;

so that when said water level rises above said low level and reaches said high level said valve closes;

so that when said water level recedes below said high level but is still above said low level said valve remains closed;

and so that when said water level recedes below said low level said valve reopens.

5. A pumping system according to claim 4 wherein said logic circuit includes a latching circuit which is actuated when said water level raises to said high level to prevent said valve from reopening and is deactivated when said water level recedes to said low level to permit said valve to reopen.

6. A pumping system according to claim 4 wherein said detector circuits each include oscillator circuits whereby each probe when not touching the water in said vacuum chamber is subjected to an oscillating electric current of reversing polarity which prevents formation of mineral deposits thereon.

7. A pumping system according to claim 1 including a normally open float type check valve located in circuit with said electrically operated valve which closes when said water level rises above said high probe.

8. In a well point pumping system which includes an impeller type pump, a vacuum chamber connected to receive water from said impeller type pump, and a vacuum pump connected to the upper end of said vacuum chamber for maintaining a vacuum in said vacuum chamber, in combination:

an electrically operated valve located between said vacuum pump and said vacuum chamber;

and electric control means for operating said valve, said electric control means comprising:

a low water level sensing probe and a high water level sensing probe near the lower end and the upper end, respectively, of said vacuum chamber;

and control circuit means connected to receive signal information from said probes and to provide control signals to operate said electrically operated valve, said electric control means operative when the water level in said vacuum chamber is rising to maintain said valve open until the water level reaches said high probe whereupon said valve closes, and being further operative when the water level is falling to maintain said valve closed until the water level recedes below said low probe whereupon said valve opens.

9. A system according to claim 8 including a normally open float type check valve located in circuit with said electrically operated valve which closes when said water level rises above said high probe.

10. In a well point pumping system, in combination:

conduit means extending over an area of ground to be drained of water and having well point means extending into the ground for extracting water therefrom;

a pump assembly connected to said conduit means for pumping water from said conduit means, said pump assembly including a pump housing and an impeller type pump mounted in said housing and for causing water to flow through said conduit means and into said housing from whence said water is then expelled;

a vacuum chamber having an upper end and a lower end, with said lower end having a port connected in fluid communication with said pump housing and for receiving water therefrom;

a vacuum pump in air receiving communication with a port at said upper end of said vacuum chamber;

power source means connected to drive said impeller type pump and said vacuum pump;

a normally open solenoid valve connected between said vacuum pump and said port at said upper end of said vacuum chamber to prevent water from flowing from said vacuum chamber into said vacuum pump;

and electrical control means for operating said solenoid valve and comprising:

a low water level probe extending into said vacuum chamber near the lower end thereof;

a high water level probe extending into said vacuum chamber near the upper end thereof;

first and second detector circuits connected to said low level and high level probes, respectively;

a logic circuit connected to said first and second detector circuits; p1 and a driver circuit connected to said logic circuit and to said solenoid valve;

said electrical control means being operative when said water level in said vacuum chamber is rising to maintain said solenoid valve open until the water level reaches said high water level probe, whereupon said solenoid valve closes;

said electrical control means being further operative when said water level in said vacuum chamber is falling to maintain said solenoid valve closed until the water level descends below said low level probe, whereupon said solenoid valve opens.

* * * * *